US005202621A

United States Patent [19]

Reischer

[11] Patent Number: 5,202,621

[45] Date of Patent: Apr. 13, 1993

[54] CURRENT TRANSFORMER ARRANGEMENT FOR THREE-WIRE THREE-PHASE SYSTEMS TO DETECT THE ACTUAL CURRENT VALUE FOR CONTROLLED DC LOADS POWERED VIA POWER CONVERTERS

[75] Inventor: Wilhelm Reischer, Vienna, Austria

[73] Assignee: Siemens Aktiengesellschaft Osterreich, Austria

[21] Appl. No.: 752,565

[22] PCT Filed: Feb. 16, 1990

[86] PCT No.: PCT/EP90/00261

§ 371 Date: Nov. 6, 1991

§ 102(e) Date: Nov. 6, 1991

[87] PCT Pub. No.: WO90/10940

PCT Pub. Date: Sep. 20, 1990

[30] Foreign Application Priority Data

Mar. 9, 1989 [AT] Austria ..... A539/89

[51] Int. Cl.[5] ..... H01F 40/06

[52] U.S. Cl. ..... 323/358; 323/361; 323/910; 324/107; 336/5; 336/175; 363/87

[58] Field of Search ..... 323/357, 358, 361, 910; 324/107, 127; 336/5, 12, 174, 175, 188; 361/93; 363/84, 87, 129

[56] References Cited

U.S. PATENT DOCUMENTS 3,668,513 6/1972 Tsubouchi et al. ..... 336/175
4,096,539 6/1978 Scaturro ..... 361/93
4,683,513 7/1987 Miller ..... 361/76
4,725,941 2/1988 Watanabe ..... 363/87
4,787,023 11/1988 Thomas ..... 363/129

FOREIGN PATENT DOCUMENTS 1227136 4/1962 Fed. Rep. of Germany .
2106732 4/1972 France .
748528 7/1970 U.S.S.R. .

*Primary Examiner*—Steven L. Stephan
*Assistant Examiner*—Jeffrey Sterrett
*Attorney, Agent, or Firm*—Hill, Steadman & Simpson

[57] ABSTRACT

In a current transformer arrangement for three-wire three-phase systems, use is made of a single busing transformer (4) arranged on the three-phase side. Two of the total of three phase conductors are pushed through the bushing transformer, specifically either with the same number of turns per unit length and in mutually opposite defined directions or with the same direction and with the ratio of different numbers of turns per unit length of 2:1 or with the same direction and a current flow halved in a phase conductor by a shunt (15). These arrangements prevent the occurrence of a zero resultant magnetic flux. The double secondary voltage produced by a double AW value occurring twice during each period is halved by an electronic correcting circuit. The control commands are derived from suitable control pulses for the thyristors (21–26) of the three-phase bridge circuit (16). Two correcting circuits are specified. The main advantage resides in the considerable saving in current transformer material and thus also in space required.

3 Claims, 4 Drawing Sheets

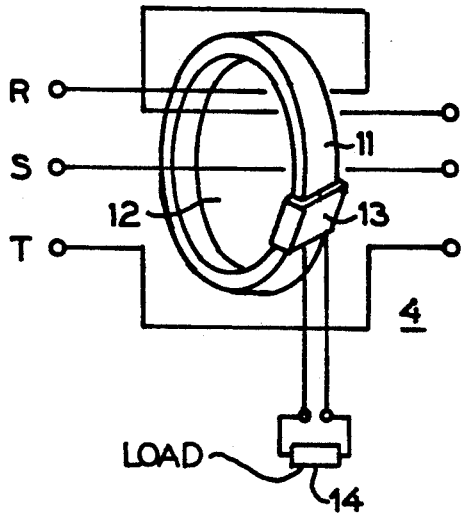
FIG.4
FIG.5A
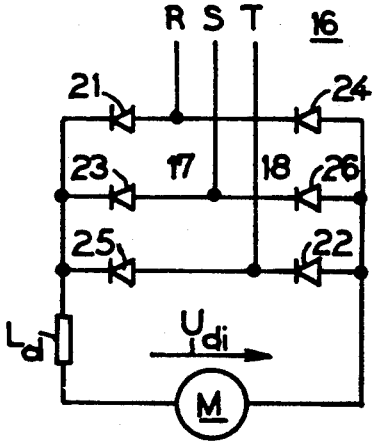
FIG.5B
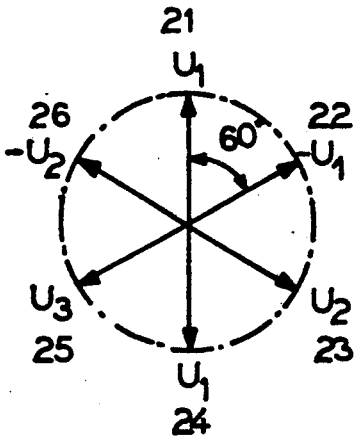

CURRENT TRANSFORMER ARRANGEMENT FOR THREE-WIRE THREE-PHASE SYSTEMS TO DETECT THE ACTUAL CURRENT VALUE FOR CONTROLLED DC LOADS POWERED VIA POWER CONVERTERS

BACKGROUND OF THE INVENTION

1. Field of the Invention

The subject matter of the invention is a current transformer arrangement for three-wire three-phase systems, especially to detect the actual current value for controlled DC loads powered via rectifiers.

2. Description of the Related Art

The line-commutated converter with controllable semiconductors is an important actuator in drive control. When rectifiers are used for controlled DC drives, it is practically only a three-phase mains that is available. In this case, the rectifier fulfills two tasks, that is to say the conversion of three-phase current into direct current in the case of DC operation, or the conversion of direct current into three-phase current in the case of invertor operation, as well as the amplification of output of the controllers to that of the machine. The variable to be controlled is the direct current supplied by the rectifier to the machine.

In order to measure or detect this direct current, it is possible in the case of larger installations having mandatory electrical isolation to make use of shunts having potential isolation (shunt converters), magnetic amplifiers (Krämer converters), Hall probes with and without modulator amplifiers or search coils. Given power converter feed, however, measurement is generally undertaken via an equivalent three-phase current, to be precise by means of three-phase transformers. The three-phase transformers provide electrical isolation. There is a strictly proportional relationship between the three-phase current and the direct current in a rectifier circuit. In a measurement principle, generally known in the prior art, for a three-phase bridge circuit, the three-phase current is detected via three conventional transformers which are designed for 0.1 A, 1 A or 5 A secondary nominal current. The secondary current is rectified and conducted via a load resistor, at which a proportional DC voltage can be tapped. A disadvantage here is the large outlay for transformer iron and winding copper for the three rectifiers, which are therefore heavy, bulky and expensive. This outlay is also still large in the generally known two-current transformer V circuit. The latter additionally has the disadvantage that upon demagnetization the converters influence one another, since their demagnetization conditions fluctuate. This can lead to hunting in the control.

SUMMARY OF THE INVENTION

In an arrangement which does not have these disadvantages, a single current transformer is provided in the form of a bushing transformer, the latter is arranged on the three-phase side and only two of the three phase conductors are threaded or pushed through the current transformer, in order to avoid the occurrence of a zero resultant magnetic flux the two phase conductors are threaded or pushed through the current transformer with the same defined direction and a ratio of the number of turns per unit length of 1:2 or with the same defined direction and the same number of turns per unit length but with a current amount halved in a phase conductor by a shunt or with the same numbers of turns per unit length but in mutually opposite defined directions, the double measuring voltage occurring on the secondary side as a result of the resultant double magnetic flux occurring in this case is halved by a correcting circuit, and the commands for switching the correcting circuit in and out are derived from control pulses for the rectifiers of the power control.

The achievable advantage resides in the considerable reduction in the outlay for only one current transformer, it being possible for the required, less complicated correcting electronics to be supplied along with the power supply for the controllers.

BRIEF DESCRIPTION OF THE DRAWINGS

The invention is explained in more detail with reference to exemplary embodiments by means of drawings, wherein:

FIGS. 2, 3 and 4 show arrangements similar in principle for the current transformer part of a circuit according to the invention, FIG. 5*a* and 5*b* shows the known circuit diagram of a three-phase bridge circuit with an associated voltage star.

FIG. 1 shows the block diagram of a conventional one-quadrant drive having a current control circuit and a speed control circuit. The power section comprises a thyristor converter 1 in a three-phase bridge circuit, commutating inductors 2, a DC motor 3, an armature current sensor in the form of current transformers 4 arranged in the three-phase circuit and a speed sensor 5 in the form of a tachometer generator coupled to the DC motor 3. The control and regulating part comprises a six-pulse drive unit 6, a current controller 7, a speed controller 8 and a desired-value generator 9 in the form of a potentiometer, the function being known. Connected downstream of the drive unit 6 is a trigger pulse transmission stage 49 with distributor logic, which serves to generate the control pulses required in each case for two thyristors that sequentially carry current. The pulse overcoupling to the respective thyristor previously in the conducting state also takes place in this stage 49.

In order to control a drive, it is necessary to have the reference variable (desired value) and the control variable (actual value) at the input of the controller. The reference variable (desired value) is prescribed as the direct voltage. The controlled variable (actual value), which is detected with a sensor, must be converted by means of a rectifier 10 to a DC voltage suitable for the controller input. The choice of sensor is governed by the requirements made of the drive. For conventional line voltages of 380/500 V or more, it is expedient to separate the control and regulating circuit electrically from the power circuit. The sensors used with drives are generally therefore designed to be electrically isolating. In fully controllable bridge circuits, the current can basically be detected on the DC side or on the AC side. The normal AC transformer as generally used for the connection of AC measuring sets is also suitable as a sensor.

Figure 1:
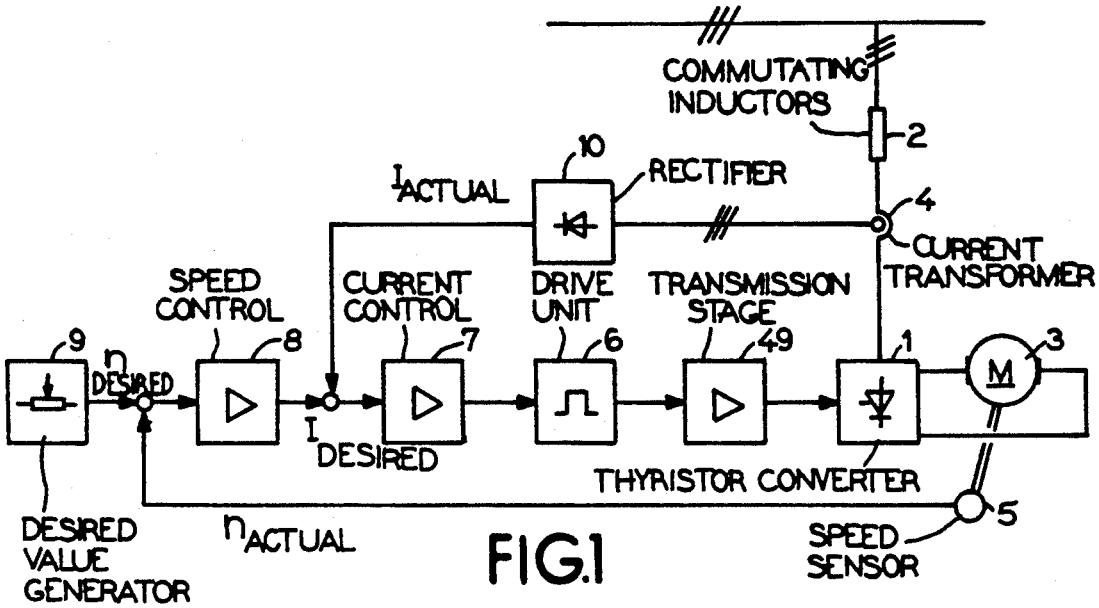
FIG. 1 shows the block diagram of a conventional one-quadrant drive having a current control circuit and a speed control circuit.
Figure 2:
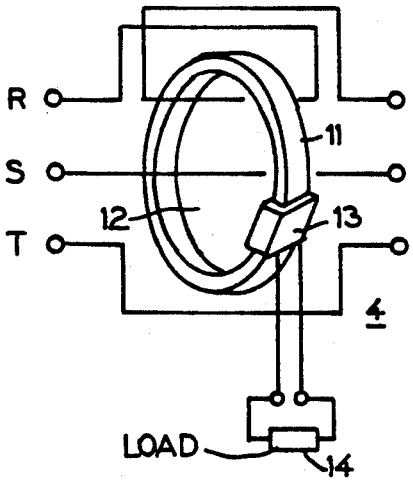
Figure 3:
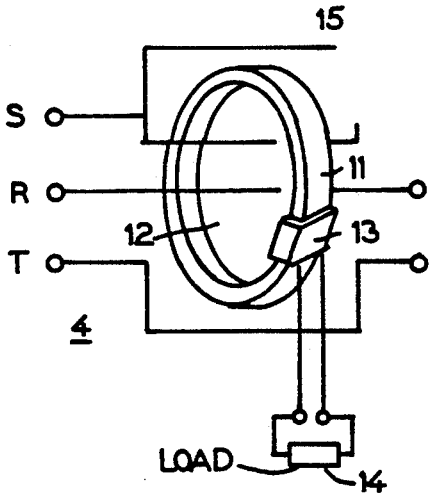

FIGS. 2, 3 and 4 show arrangements similar in principle for the current transformer part of a circuit according to the invention. A so-called bushing transformer is used here. Bushing transformers, which are commercially available and much used for relatively high current strengths, have a through opening, or window, 12 completely surrounded by the iron core 11. It is not the likewise present primary winding, which is led to terminals, that is used for relatively high current strengths, but a primary current conductor led once or more than once through the through opening 12 of the current transformer 4 and which, for example, is led through six times for a primary current nominal value of 100 A or once for a primary current nominal value of 600 A, in order to achieve the required nominal magnetic flux of, for example, 600 AW. The secondary winding 13 is mostly designed for a nominal current of 5 A (1 A, 0.1 A). Only the turns in the interior of the through opening 12 count as primary windings. Naturally, it depends on the direction of current flow whether the AW contribution of a conductor is to be assessed as positive or negative. Whereas it is usually conventional to use three such current transformers or, in the two-current transformer V circuit, at least two current transformers, for the purpose of measuring three-phase currents, it being possible owing to unequal demagnetization conditions for the two current transformers for the latter circuit to lead to controller oscillations, according to the invention only one bushing transformer is used. As a result, there is a large saving in weight, volume and cost.

It may be seen from FIGS. 2, 3 and 4 that in each case only two of the total of three phase conductors of the three-phase system are led through the through opening 12 of the current transformer 4, specifically in the ways according to the invention that are described below. In the arrangement according to FIG. 2, the essence, to be precise the prevention of the occurrence of a zero resultant magnetic flux and thus of a gap in the secondary current, is achieved by leading the two conductors R, S through the through opening 12 of the current transformer 4 in mutually opposite directions. It is, of course, necessary to take account of the loop numbers required depending on the current strength occurring. The third conductor T is led past the iron core 11 of the current transformer 4, on the outside.

In FIG. 4, a conductor, e.g. S, is pushed through once, and a conductor, e.g. R, twice, with the formation of a feedback loop. In this arrangement, the two conductors have the same defined direction. The third conductor T is likewise led past the iron core 11 of the current transformer 4, on the outside.

The AW ratio of 2:1 required according to the invention is achieved in FIG. 3 by pushing through two conductors once, but leading half the current in the case of one conductor through a shunt 15 past the iron core 11 of the current transformer 4, on the outside. Of course, this requires the shunt 15 and the shunted conductor part to have the same impedance. Moreover, it is necessary here to apply a different conversion constant in the case of calibration. The resultant magnetic flux produced in each case when current flows in the two pushed-through conductors generates an impressed current in the secondary winding 13, which flows via the connected load resistor 14. The variation of the resultant magnetic fluxes (AW) and of the secondary currents proportional thereto, which are generated as a result of the arrangement according to the invention of the conductors and of the conductor currents flowing therein, is shown in the following figures.

FIG. 5a shows the known circuit diagram of a three-phase bridge circuit 16, which consists of the two three-pulse star circuits 17, 18. It has six thyristors 21–26, which-are connected symmetrically to the phases R, S, T. FIG. 5b drawn therebelow is the voltage star of the six voltages following one another at 60° in each case. The thyristors must be triggered one after another in this sequence. The numerals 21–26 on the voltage star, which correspond to the reference numerals for the thyristors, indicate this sequence.

Figures 6A, 6B, 6C, 7A, 7B, 7C:
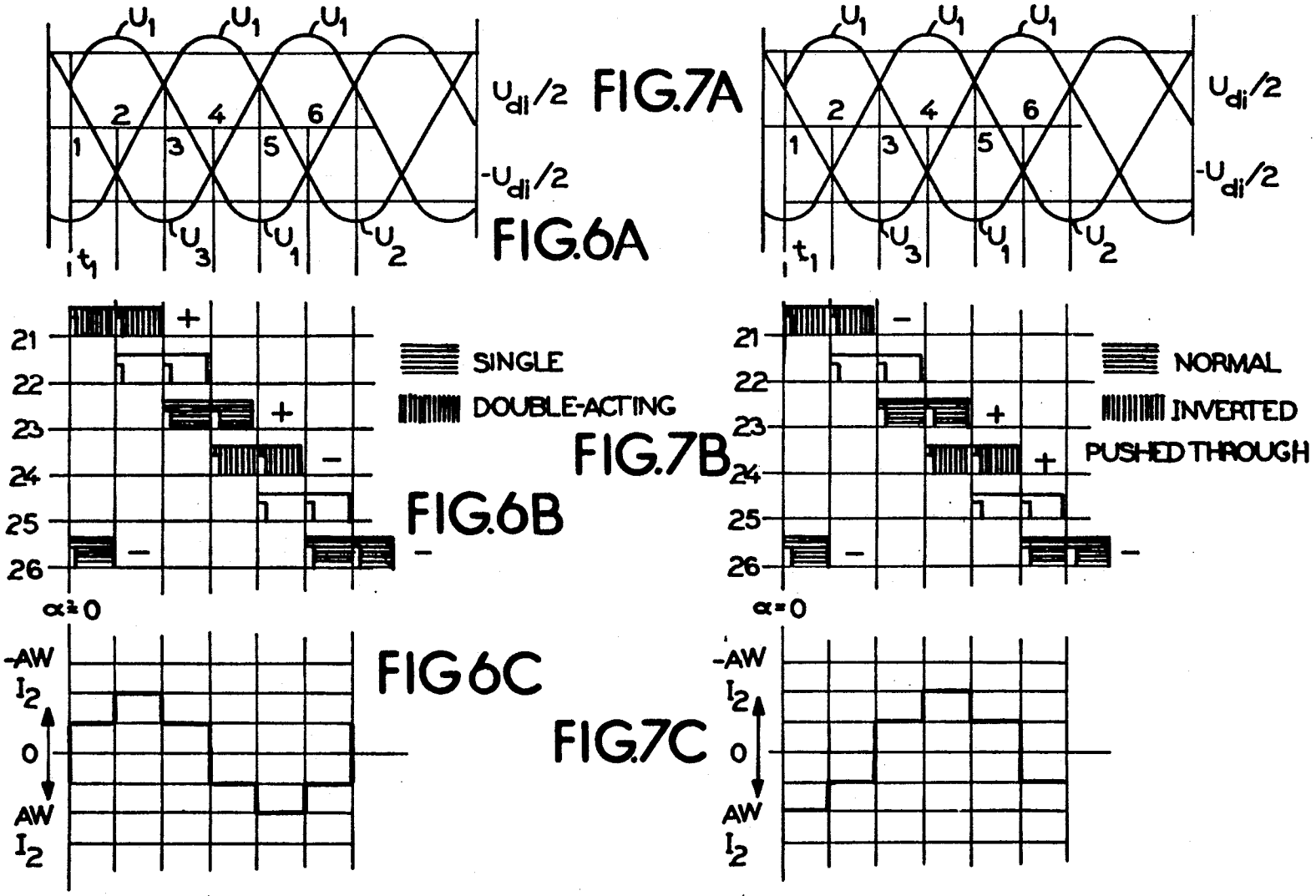
FIGS. 6*a*, 6*b*, 6*c*, 7*a*, 7*b* and 7*c* show the temporal occurrence of the star voltages, control pulses, thyristor currents and the determining secondary variables.

The temporal variation of the three star voltages $U_1$, $U_2$, $U_3$ of the two three-pulse star circuits 17, 18, of which the three-phase bridge circuit 16 consists, are represented in FIG. 6a for the firing angle $\alpha=0°$. These voltages, connected in series, produce the resultant voltage $U_{di}$. Indicated thereinbelow in FIG. 6b is the temporal allocation of the trigger pulses for the individual thyristors 21–26, which are represented cross-hatched, as well as the blocks of the thyristor currents flowing in this case, the latter in diagrammatic form for the sake of a simplified explanation of the principle. Further hatching emphasizes the thyristor current blocks in terms of their significance for the example of the arrangement according to the invention in accordance with FIG. 4. Since the lead wires R and S are pushed through, and the currents flowing in them therefore generate magnetic fluxes of positive and negative type, but of amounts differing by the factor 2, the single-acting current blocks, which flow in the lead wire S and thus alternately in the thyristors 23 and 26, are marked by horizontal hatching, and the double-acting current blocks, which flow in the lead wire R and thus alternately in the thyristors 21 and 24, by vertical hatching. The current blocks through the thyristors 22 and 25 exert no influence. Geometrical addition of the simultaneously occurring current blocks yields the waveform of FIG. 6 drawn below for the directional magnitude of the resultant magnetic flux, which is generated by the currents penetrating the through opening 12 in the positive or negative current direction, which corresponds on a different scale to the measuring current flowing in the secondary winding 13 or the load voltage = measuring voltage occurring at the load resistor 14. It is possible by using the waveform to identify the detection of all the primary currents continuously and with the correct sign. However, a double secondary current still occurs, to be precise exclusively in the time interval in which there is a simultaneous flow of current through the conductor R, pushed through twice, and the conductor T, which is not pushed through, i.e. through the thyristors 21 and 22 or 24 and 25. Since, moreover, negative current values that cannot be used for the controllers 7, 8 occur, the corrections required are undertaken by circuits described below. The same shape of the waveform also occurs for the arrangement in accordance with FIG. 3, but with scale ratios altered by the factor 2, as already mentioned in the description of this figure.

The secondary current or AW ratios for the arrangement in accordance with FIG. 4 are specified in FIGS. 7a, 7b, and 7c. By virtue of the references previously made, the waveform is easy to construct, it being necessary to note that here the current blocks occurring for the flow of current through the conductor R, pushed through twice, and the thyristors 21 and 24 are highlighted by vertical hatching.

Figure 8:
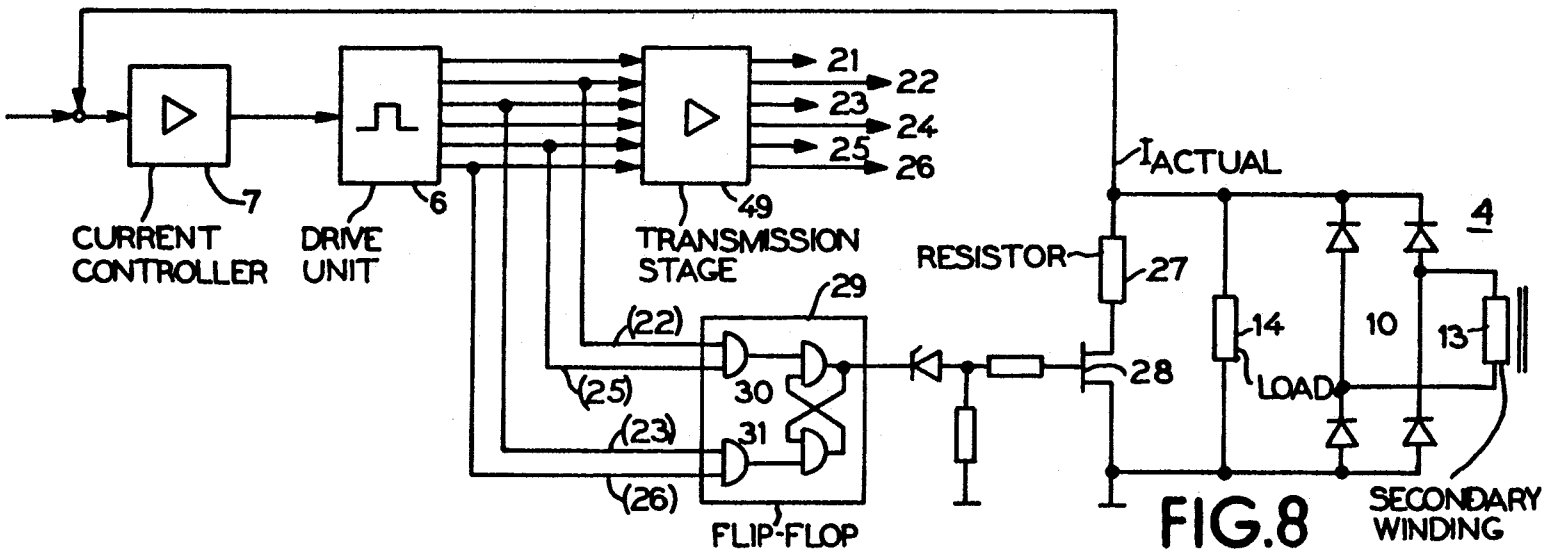
FIGS. 8 and 9 show two embodiments of the electronic correcting circuit.

The correcting circuit according to FIG. 8 shows the load resistor 14, which is connected via a rectifier 10 to the secondary winding 13 of the current transformer 4. During the time interval of double AW number, a resistor 27 of the same size is connected in parallel to the load resistor 14 via a transistor 28. As a result, only a load resistor having half the resultant ohmic value is available to the measuring current occurring with double its value, so that the desired correction is performed. For this purpose, the transistor 28 is controlled by a flip-flop 29 in the conducting state, which is set by means of the non-overcoupled control pulse (low rate) for the thyristor 22 or 25, and is reset by means of the respectively subsequent non-overcoupled control pulse for the thyristor 23 or 26. For this purpose, the control lines for the thyristors 22 and 25 are also connected to the inputs of an AND stage 30, whose output is connected to the set input of the flip- flop 29. In the same way, the control lines for the thyristors 23 and 26 are also connected to the inputs of an AND stage 31, whose output is connected to the reset input of the flip-flop 29. The rectification of the measuring current is performed in a known way by means of the rectifier 10. Given a different arrangement of the conductors R, S, T with respect to the current transformer 4, it is necessary, as already stated earlier, to use a different sequence of the control pulses serving to set and reset the flip-flop 29. This also holds, of course, for an arrangement of the conductors according to FIG. 2, in which according to the invention two of the three primary conductors are led with mutually opposite through directions through the through opening 12 of the current transformer 4. As is evident from FIG. 7, a double value of the resultant AW or of the secondary current occurs when both the pushed-through conductors simultaneously carry current, i.e. in the example the conductors R and S and the associated thyristors 21 and 26 or 23 and 24. Thus, here the control pulses for the thyristors 21 and 24 are also to be used for setting, and the respectively subsequent control pulses for the thyristors 22 and 25 are also to be used for resetting the flip flop 29. It can be seen here, and is also to be emphasized, that the resultant waveforms always occur in the same shape, whereas the position of the double values for AW or secondary current is different depending on the arrangement of the conductors with respect to the current transformer 4.

The advantage of this circuit is that in the case of the current detected at double value the iron core 11 of the current transformer 4 is not magnetized twice as high, since in this case the resultant load resistor 14 || 27 occurs with half the ohmic value. The additional outlay on magnetization comes only in the copper internal resistance of the secondary winding 13. There is therefore no need for a higher type rating of the current transformer 4.

Figure 9:
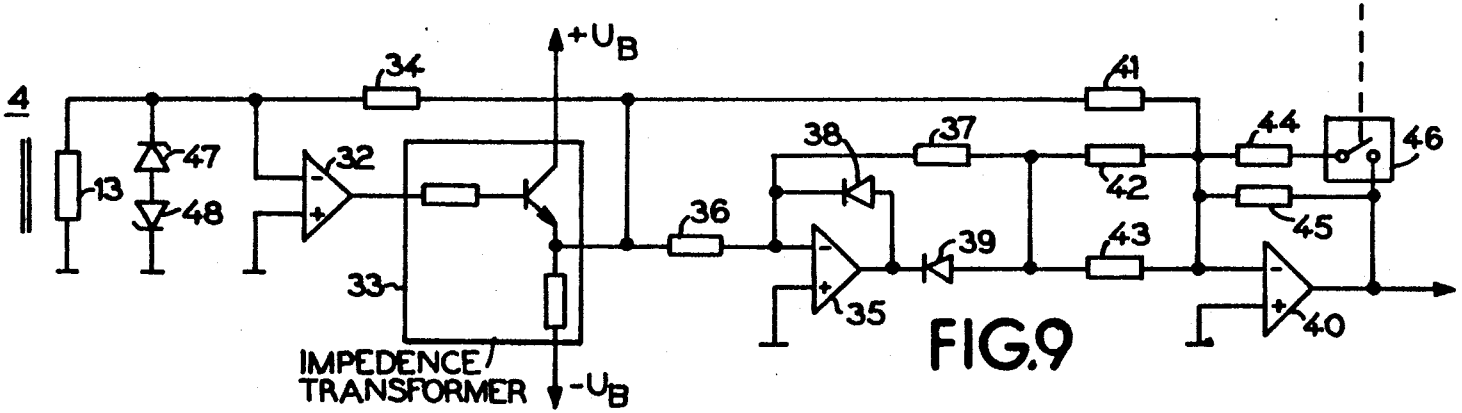

A correcting circuit having somewhat more complicated electronics is specified in FIG. 9. By using an operational amplifier 32, it is possible in this circuit to load the current transformer 4 only with a very small load voltage. An impedance transformer 33 is connected downstream of the operational amplifier 32, in order to be able to use an operational amplifier 32 of a type having low current-carrying capacity.

The load voltage, which is rectified via a full-wave meter rectifier or absolute-value generator in a known circuit, drops at the load resistor 34. Its first operational amplifier 35, which functions as an inverting rectifier, is wired to the resistors 36 and 37, which have the same ohmic values, and to diodes 38 and 39. Its second operational amplifier 40, which functions as an inverting amplifier, is wired in the manner shown to the resistors 41–45, which have the same ohmic values.

Its amplification can be switched between its full and half value by an electronic switch 46. The control of this switch 46 is once again performed by the output signal of the flip-flop 29 shown in FIG. 8.

The zener diodes 47, 48 serve to derive the load current, and thus as overvoltage protection for the operational amplifier 32 in the event that overvoltages occur in the secondary winding 13 of the current transformer 4, which are caused by highly dynamic processes in the primary circuit, for example by switching operations or short circuits. The advantage of this circuit is that the current transformer 4 virtually operates with respect to the load voltage zero, and therefore only a very small magnetization current occurs. As a result, this circuit is particularly suitable for measuring the actual current with the correct instantaneous value together with downstream indication of current zero via triggers. This is so because the magnetization current, which causes disturbance during indication of current zero and is known to delay the indication of current zero by causing the so-called "drag" of the demagnetization voltage, can be kept at a minimum value.

It remains to be mentioned in conclusion that the electronic correcting circuit is not required in the case of pure current zero indication, of current or power measurements using pointer or digital instruments, or of controls with a large filter time constant, since in the first case interest centers only on the vanishing of the current, and in the other cases the error caused by the measuring current occurring with double value can be calibrated into the display or compensated.

Although other modifications and changes may be suggested by those skilled in the art, it is the intention of the inventors to embody within the patent warranted hereon all changes and modifications as reasonably and properly come within the scope of their contribution to the art.

We claim:

1. A current transformer arrangement for three-wire three-phase systems to detect actual current value for controlled DC loads powered via power converters having rectifiers controlled via control pulses, comprising: a single current transformer comprising a bushing transformer with a primary side and a secondary, said bushing transformer being on a three-phase side of the three phase system and only two phase conductor wires of the three phase conductor wires are passed through the primary side of the current transformer, in order to avoid the occurrence of a zero resultant magnetic flux the two phase conductor wires pass through the current transformer with the same current flow direction and a ratio of the number of turns per unit length of 1:2; a correcting circuit means connected to said secondary side for halving a double measuring voltage occurring on the secondary side as a result of resultant double magnetic flux, and said correcting circuit means including means for deriving correction control pulses for switching the correcting circuit means in and out from the control pulses for the rectifiers of the power converter.

2. A current transformer arrangement for three-wire three-phase systems to detect actual current value for controlled DC loads powered via power converters having rectifiers controlled via control pulses, comprising: a single current transformer comprising a bushing transformer with a primary side and a secondary, said bushing transformer being on a three-phase side of the three phase system and only two phase conductor wires of the three phase conductor wires are passed through the primary side of the current transformer, in order to avoid the occurrence of a zero resultant magnetic flux the two phase conductor wires pass through the current transformer with the same current flow direction and the same number of turns per unit length but with a current amount halved in a phase conductor by a shunt; a correcting circuit means connected to said secondary side for halving a double measuring voltage occurring on the secondary side as a result of resultant double magnetic flux, and said correcting circuit means including means for deriving correction control pulses for switching the correcting circuit means in and out from the control pulses for the rectifiers of the power converter.

3. A current transformer arrangement for three-wire three-phase systems to detect actual current value for controlled DC loads powered via power converters having rectifiers controlled via control pulses, comprising: a single current transformer comprising a bushing transformer with a primary side and a secondary, said bushing transformer being on a three-phase side of the three phase system and only two phase conductor wires of the three phase conductor wires are passed through the primary side of the current transformer, in order to avoid the occurrence of a zero resultant magnetic flux the two phase conductor wires pass through the current transformer with the same numbers of turns per unit length but in mutually opposite current flow directions; a correcting circuit means connected to said secondary side for halving a double measuring voltage occurring on the secondary side as a result of resultant double magnetic flux, and said correcting circuit means including means for deriving correction control pulses for switching the correcting circuit means in and out from the control pulses for the rectifiers of the power converter.

* * * * *